US009254899B2

(12) United States Patent
Sparks et al.

(10) Patent No.: US 9,254,899 B2
(45) Date of Patent: Feb. 9, 2016

(54) BUOYANCY CONTROL SYSTEM

(71) Applicant: Scuba Lab LLC, Round Rock, TX (US)

(72) Inventors: Shannon Patrick Sparks, Pflugerville, TX (US); Timothy Lee Earles, Houston, TX (US)

(73) Assignee: Scuba Lab LLC, San Antonio, TX (US)

( * ) Notice: Subject to any disclaimer, the term of this patent is extended or adjusted under 35 U.S.C. 154(b) by 208 days.

(21) Appl. No.: 13/912,362

(22) Filed: Jun. 7, 2013

(65) Prior Publication Data

US 2013/0327263 A1 Dec. 12, 2013

Related U.S. Application Data

(60) Provisional application No. 61/657,050, filed on Jun. 8, 2012, provisional application No. 61/663,101, filed on Jun. 22, 2012.

(51) Int. Cl.

| | |
|---|---|
| ***B63C 7/00*** | (2006.01) |
| ***B63C 7/10*** | (2006.01) |
| ***B63C 7/02*** | (2006.01) |
| ***B63B 22/22*** | (2006.01) |
| ***B63G 8/00*** | (2006.01) |
| ***B63G 8/24*** | (2006.01) |

(52) U.S. Cl.

CPC . *B63C 7/02* (2013.01); *B63B 22/22* (2013.01); *B63C 7/10* (2013.01); *B63G 8/001* (2013.01); *B63G 8/24* (2013.01); *B63B 2207/02* (2013.01)

(58) Field of Classification Search

CPC B63B 2207/02; B63B 2738/02; B63B 22/22; B63G 8/00; B63G 8/001; B63G 8/14; B63G 8/24; B63C 7/02; B63C 7/10

USPC ..... 114/49, 53, 54, 315; 405/186

See application file for complete search history.

(56) References Cited

U.S. PATENT DOCUMENTS

| | | | |
|---|---|---|---|
| 1,373,643 | A | 4/1921 | Arivra |
| 2,968,053 | A | 1/1961 | Gogolick et al. |
| 3,090,976 | A | 5/1963 | Liu |
| 3,171,376 | A | 3/1965 | Sellner et al. |
| 3,487,647 | A | 1/1970 | Brecht |

(Continued)

OTHER PUBLICATIONS

Flanagan, David, "Mitigation of Uncontrolled Ascents in Underwater Lift Bags Used in Marine Salvage", Thesis, 2009, 99 pages, University of Alabama, Dept. of Mechanical and Aerospace Engineering,Huntsville, Alabama.

*Primary Examiner* — Anthony Wiest

(74) *Attorney, Agent, or Firm* — Garlick & Markison; Edward J. Marshall

(57) ABSTRACT

A buoyancy-based lifting system can be dynamically controlled to lift, move, or hold a load an object of arbitrary size at a fixed depth. The control system can control the trajectory of a flexible gas-filled lift bag and attached load by opening or closing inflation and deflation valves based on ambient pressure readings obtained during a lift. Stable control can be achieved and maintained without having to directly measure the actual volume of gas in the lift bag, and without having to accumulate measurements of gas flows into and out of the bag. A controller can pre-determine limits of instability and lift control parameters, then use this information in conjunction with ambient pressure readings to prevent the system from becoming unstable during a lift. User intervention is generally unnecessary to maintain the system's instability.

7 Claims, 9 Drawing Sheets

(56) References Cited

U.S. PATENT DOCUMENTS

| | | | | |
|---|---|---|---|---|
| 3,492,513 | A | 1/1970 | Hollander et al. | |
| 4,510,878 | A | 4/1985 | Breedlove | |
| 4,586,136 | A * | 4/1986 | Lewis | 73/291 |
| 4,882,678 | A * | 11/1989 | Hollis et al. | 73/865.1 |
| 5,746,543 | A | 5/1998 | Leonard | |
| 6,772,705 | B2 | 8/2004 | Leonard | |
| 6,792,872 | B1 * | 9/2004 | Valdespino | 104/22 |
| 2013/0259579 | A1 | 10/2013 | Bonzon et al. | |

* cited by examiner

BUOYANCY CONTROL SYSTEM

CROSS REFERENCE TO RELATED PATENTS

This application claims the benefit of U.S. Provisional Application No. 61/657,050, filed Jun. 8, 2012 and entitled, "Buoyancy Control System," and U.S. Provisional Application No. 61/663,101, filed Jun. 22, 2012 and entitled, "Buoyancy Control System," both of which are incorporated herein by reference in their entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND

1. Technical Field

This disclosure relates generally to lifting loads using buoyancy-based lifting systems, and more particularly to controlling buoyancy-based lifts.

2. Description of Related Art

The marine salvage industry, off-shore oil & gas industry, nautical archeology, and military operations often use air lift bags to move or recover objects in bodies of water. Two types of lift bags exist: the open-bottom or parachute-type, and the enclosed type. Both types are constructed of flexible fabric and filled with air, another gas, or sometimes another lighter-than-water fluid, to create a buoyant force to lift an object. Rigid, fixed volume devices, such as ballast tanks have also been used for buoyant lifts.

Conventional flexible lift bag systems tend to become unstable during a lift, because the partially-inflated lift bag changes volume inversely with depth, and therefore tends to accelerate upward or downward when displaced even slightly from a position of neutral buoyancy. The risks of instability include diver entanglement in a rapid, uncontrollable ascent or descent, potentially causing injury or death. Also, the lift bag, and load being lifted, may broach the surface at high speed, possibly causing the loss of gas from an open-bottom bag, followed by uncontrolled descent. The high speed ascent or broaching itself may damage the object being lifted. Using lift bags to overcome seabed suction, or to free mechanically-locked or snagged equipment, can also be problematic, as the amount of buoyant force needed to lift the load becomes suddenly less as soon as the load is freed.

In practice, elaborate precautions are often needed in lift-bag operations, such as dead-man anchors and restraining lines, and/or vertically-staged multiple lift-bag arrays which prevent the load from going up in an uncontrolled fashion.

Although rigid volume lifting devices, such as ballast tanks may not suffer from the volume-change instability of flexible lift bags, the rigid volume devices can be excessively cumbersome due to their large size and weight, making them more difficult to transport than flexible lift bags.

BRIEF SUMMARY OF THE INVENTION

Various embodiments of a buoyancy-based lifting system include a flexible lift bag, or any vessel in which the contained gas is responsive to the ambient pressure of the water, configured to be coupled to a load to be lifted; one or more valves that can be used to inflate or deflate the flexible lift bag by adding or removing a compressible fluid to the lift bag; a pressure sensor used to obtain ambient pressure measurements during a lift, i.e. pressure measurements external to the flexible lift bag; and a lift-controller that uses the ambient pressure measurements to estimate impending instabilities during a lift. The lift controller can dynamically stabilize movement of the lifting system by inflating or deflating the lift bag to avoid the impending instabilities. In some embodiments, multiple valves, including one or more inflation valves, one or more deflation valves and one or more manual override valves are included in the buoyancy-based lifting system.

The lift controller can include a waterproof housing and sealed, or sealable, electrical connectors to allow the lift controller to be operated underwater, by a diver located close to the load being lifted. If the lift controller is to be operated local to the load being lifted, a pressure sensor included in the lift controller can be used to obtain the pressure measurements used to dynamically stabilize the load during the lift. In some embodiments, pressure readings obtained from a pressure sensor included in the lift controller, or another pressure sensor located near or attached to the load, are the only "live" sensor readings used to stabilize the load and the lift system during a lift. In other embodiments, readings taken using load cells and other devices can be used in conjunction with the pressure measurements obtained from the pressure sensors.

The lift controller can include a simulation module used to simulate the lift both prior to the actual lift and during the actual lift, and a lift control module. Various embodiments employ the simulation module during the actual lift to predict a future instability ratio in near-real time based on the pressure measurements obtained from one or more pressure sensors. The lift-control module can be used during the lift to control one or more inflation and deflation valves based on both the future instability ratio predicted by the simulation module and on a current instability ratio, also capable of being calculated in near-real time.

In some embodiments, a simulation module is used to generate a lift plan prior to the lift. The simulation can be iteratively performed until an acceptable lift plan is achieved. The acceptable lift plan can be stored in a memory included in the lift controller. The lift can be nominally executed according to the lift plan, which in some embodiments includes valve control and anticipated instability information. If actual sensor readings or instability predictions developed during the lift indicate that deviation from the lift plan is needed, the lift controller can dynamically change or deviate from the original lift plan by activating the valves, changing valve burst times, or taking other actions as appropriate. The phrase, "burst time," refers to the time duration that an inflation or deflation valve is open to supply or remove gas from the lift bag.

The lift controller can, in some embodiments, include or be connected to a user interface that includes a graphical display and one or more indicators, including instability indicators and warning signals. Appropriate warnings and displays can be provided to a diver or other operator based on deviation from predicted instability parameters, or exceeding a threshold instability level.

BRIEF DESCRIPTION OF THE SEVERAL VIEWS OF THE DRAWING(S)

Figure 9:
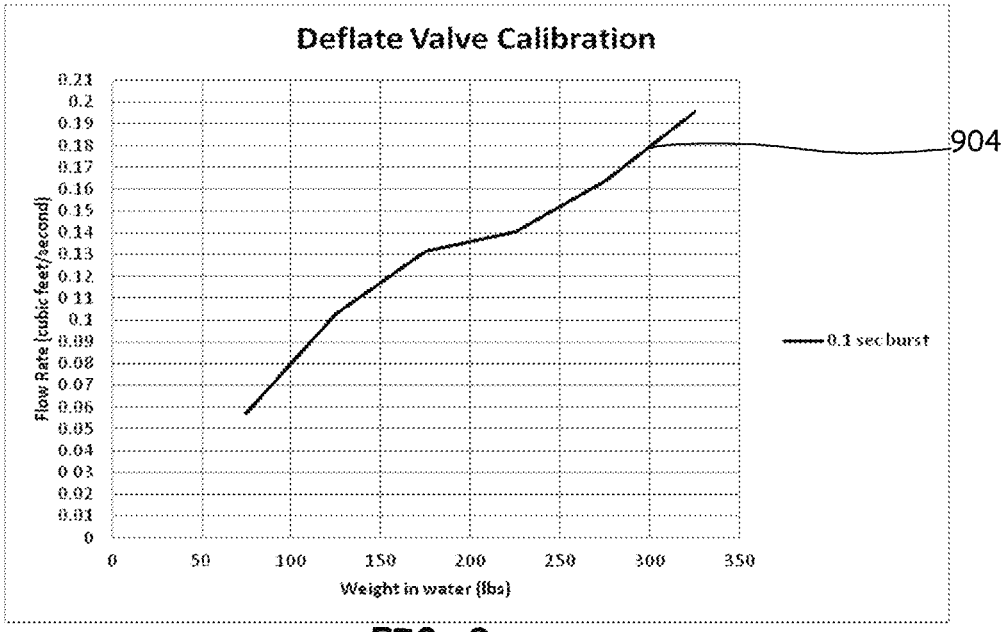
Figure 7:
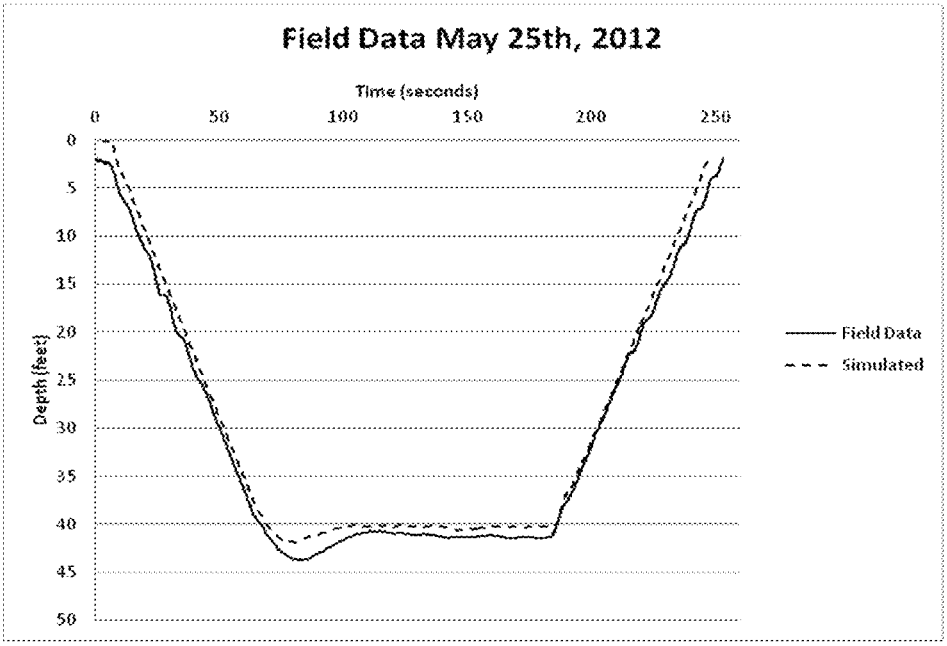
Figure 8:
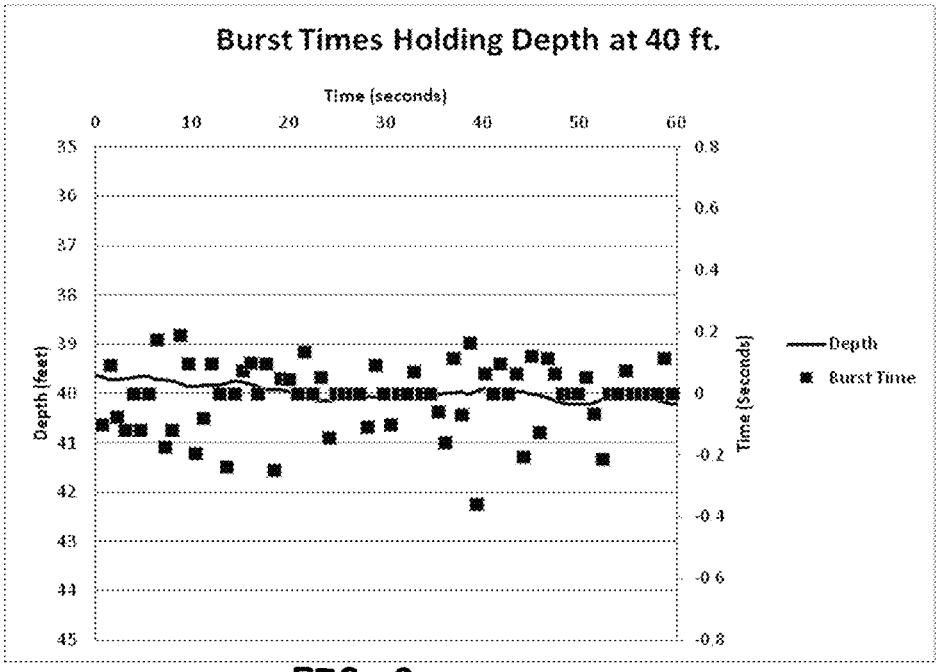

FIG. 7 compares simulated and actual data from a field trial on May 25, 2012;

FIG. 8 shows the Hold Depth Mode from FIG. 7 expanded with the valve burst times plotted on the secondary axis;

FIG. 9 shows a characteristic flow rate of a deflation valve as a function of the weight of the load, in water, being supported by a buoyancy-based lifting system according to various embodiments of the present disclosure.

DETAILED DESCRIPTION

As used herein, the term "compressible fluid" refers to a gas or liquid used in flexible buoyant lift bags. In general, compressible fluids will expand or contract the volume of a lift bag depending on the pressure present at any particular depth under water. The term gas is used generally throughout this description, but it should be understood that another compressible fluid can, in many instances, be substituted for a gas.

The terms "lift bag" and "flexible lift bag" may be used interchangeably herein, unless otherwise specified or required by the context of the term, and usually refer to containers with non-rigid-walls, either partially or fully enclosed, used in buoyant lifting systems. For most flexible lift bags, the pressure inside of the lift bag is slightly higher, but approximately equal to the pressure outside of the lift bag, because the walls of the lift bag flex in response to the expansion or contraction of the gas inside, and the pressure outside of the lift bag. The exact pressure inside a flexible lift bag can, however, vary depending on the velocity of the system, the shape of the bag, the weight and drag of the load, and similar considerations.

The present disclosure describes various methods, systems, and devices that can be used to buoyantly lift loads. Some embodiments described herein can reduce, improve, or eliminate instability problems associated with conventional buoyant lifting techniques. Various embodiments achieve stability during lifts by dynamically controlling the velocity of descent and ascent of buoyant loads using pressure measurements obtained during a lift. The volume of gas within the lift-bag need not be measured, directly or indirectly, by detecting a water level, measurement of pressures within the bag, volume measuring sensors, by calculating the cumulative volume by measuring the flow of gas through the valves, or otherwise.

These pressure measurements can be used to determine a degree of current or predicted instability in near-real time, which permits making dynamic adjustments to a pre-stored lift plan. Some embodiments provide the ability to hold a lift bag and its load at a substantially stationary depth, with relatively minor oscillations and low amounts of gas-consumption.

Furthermore, although the system and techniques described herein are useful for lift bags, various embodiments can also be adapted for use with diver buoyancy control and autonomous vehicular control.

In operation, various embodiments employ a numerical simulation of the lifting system's motion in water before a lift, calibrating the lifting system prior to a lift, and a direct simulation of the lifting system's motion during an actual lift. A typical calibration of various disclosed embodiments can include calibrating inflation and deflation valves and other parameters, identifying boundaries of instability, and determining parameters of control. The boundaries of instability can include an instability ratio, derivatives of the instability ratio, and a Critical Velocity.

Various embodiments of a lift system described herein enable a diver to plan a lift, and to be apprised prior to the lift, of the level of risk of instability at any point in the lift. The same system can then be used to stably control vertical movement of an object underwater. The vertical movement of the object can be controlled for either constant-velocity ascent or descent, or in holding a constant depth. Note that when the phrase "during a lift" is used herein, the term should be understood to include ascents, descents, and holding at a constant depth.

During a lift, various implementations of the techniques disclosed herein allow a lift system to autonomously and stably execute a pre-planned sequence of lift operations in substantially any combination of controlled ascent, controlled descent, and controlled hold-depth operations. Some such lift systems can stably move an object in controlled ascent, controlled descent, and controlled hold-depth operations at the active command of a diver in real time. Visible, tactile, sonic, or other indications can be provided to the diver regarding important variables such as current depth, a current mode of operation, actual and planned lift trajectories, and a risk of instability at some or all points during the lift.

Figure 1:
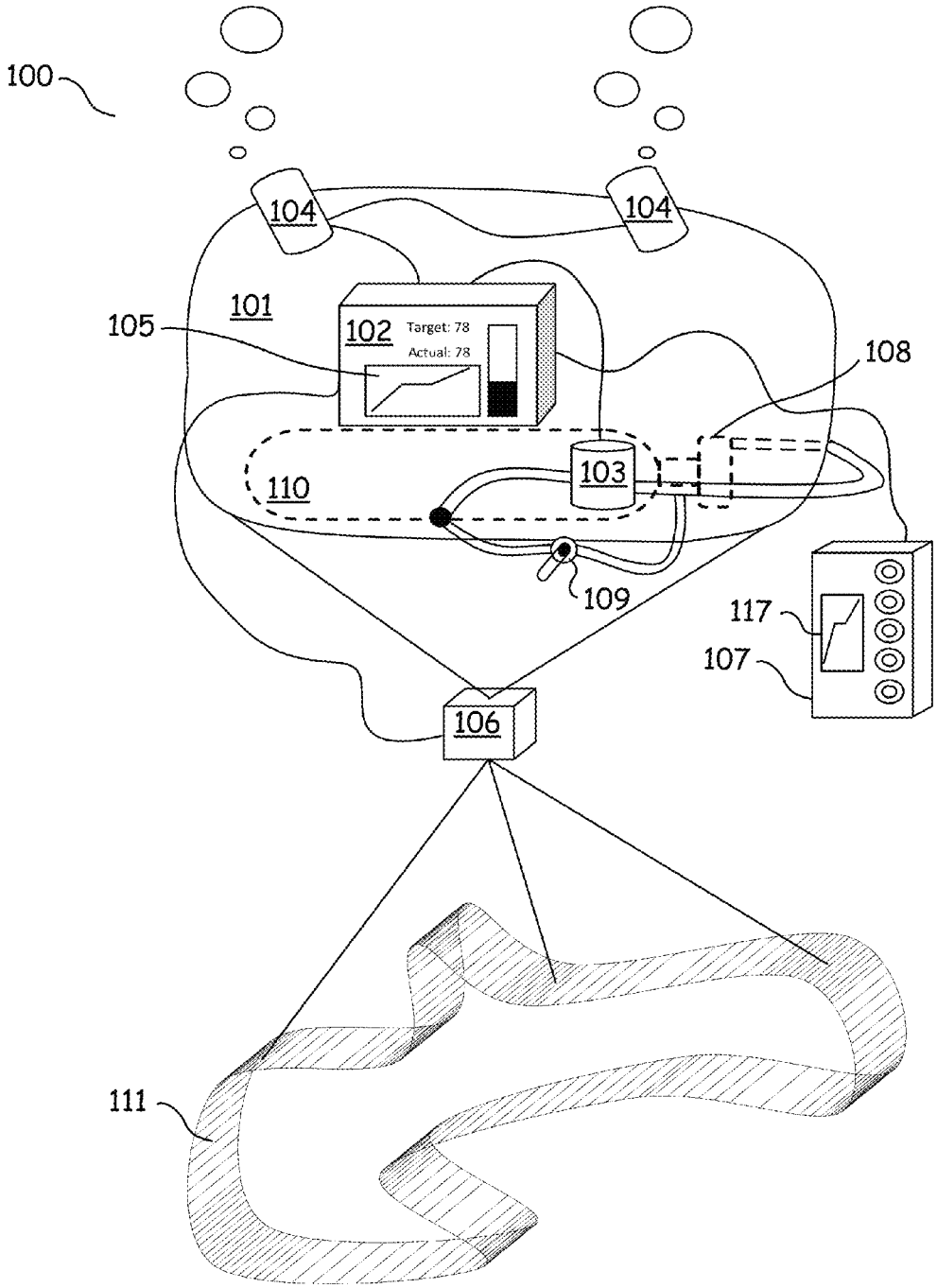
FIG. 1 is a schematic representation of a buoyancy-based lifting system, according to various embodiments of the present disclosure.

FIG. 1 is a schematic representation of a buoyancy-based lifting system 100, according to various embodiments of the present disclosure. Lifting system 100 comprises a flexible lift bag 101 connected to load 111 via load cell 106; valves, including deflation valves 104, inflation valve 103 and manual valve 109; a gas source 110 connected to pressure regulator 108 and inflation valve 103; and lift controller 102. Lift controller includes visual display 105, and is communicatively connected to deflation valves 104, inflation valve 103, load cell 106, and diver controls 107, which can include a visual display 117 in addition to, or in place of, the visual display 105 included on lift controller 102. Diver controls 107 can be coupled to controller 102 via wired or wireless technologies.

Lift bag 101 can be fully enclosed or open, and of arbitrary size and shape. The size and shape of lift bag 101 need not be known to the user at the time of operation, as long as the lift bag 101 has sufficient static and dynamic volumes. In general, the static volume should be sufficiently large to generate ample buoyant force to counteract the gravitational of load 111, and sufficient dynamic volume to allow gas to be added or removed for control purposes. In some embodiments, a processing device obtains user inputs specifying, for example, a desired size of a lift bag, desired valve types, estimated weight of the object, volume/displacement of the object, shape of the object, and one or more uncertainty factors. This information can be used to determine the amount of lift-buoyancy needed, the number of valves required, and other lift parameters.

During normal operation, the volume of gas inside lift bag 101 is controlled by inflation valve 103 and deflation valves 104, but manual valve 109 can be used to control either or both inflation and deflation of lift bag 101. Inflation valve 103 and deflation valves 104 should be of sufficient and predictable flow rate, and of sufficient and predictable actuation speed to permit control of the system. In at least one embodiment, inflation valve 103 and deflation valves 104 are direct acting solenoid valves. In at least one embodiment, multiple deflation and/or inflation valves are used.

Gas source 110 should be capable of supplying a sufficient and predictable flow rate for controlling the system; otherwise any desired gas source can be used. If gas source 110 is of higher pressure than the valves 103 and 104 are capable of resisting, a pressure regulator 108 can be used.

Lift controller 102 can include waterproof enclosure that allows lift-controller 102 to be operated at-depth. That is to say, lift controller 102 can be fastened, joined, enclosed in, placed on, tethered, attached to, or carried near lift bag 101 or load 111 during an actual lift. Lift controller 102 can include a microcontroller, a general purpose or dedicated processor running various software or firmware modules or other code, discreet components and logic elements, and any other electrical, optical, and mechanical switches, sensors, jacks, connectors and the like. During a lift, the processor or processing circuitry of lift controller 102 can dynamically control the lift based on readings or other information obtained from an ambient pressure sensor (not illustrated), or based on pressure sensor data and data from various other optional sensors, e.g. load cell 106.

In at least one embodiment, during an actual lift, the only sensor input used by the lift-controller 102 to dynamically stabilize movement of the buoyancy-based lifting system 100 is sensor input from one or more pressure sensors that provide ambient pressure readings representative of pressure readings at or near lift bag 101. In at least one embodiment, one or more pressure sensors can be at any position relative to the lift bag, as long as the positional relationship remains generally consistent during the lift. One of the lift parameters can be specified to be a relative distance between a sensor and a specified portion of the lift system.

In one embodiment, the pressure sensor can be implemented using a linear, or non-linear, strain gauge potentiometer, such as a piezoresistive strain gauge. Other types of pressure sensors, for example sensors that employ capacitive, electromagnetic, optical, and potentiometric technologies, can also be used. In some embodiments, various additional sensor readings can be obtained from load cell 106 to assist in determining the nature and situation of the load before or during a lift, such as whether the load is stuck, as well as during valve calibration. A pressure transducer may be attached in line with the gas supply to estimate remaining gas in the supply if the supply is fixed volume in nature.

Lift controller 102 can include a visual display 105 and diver control 107, which provide a means of communication with a diver, or other operator monitoring or employing lift-controller 102. Visual display 105 and diver controller 107 can be implemented in various different ways. For example, visual display 105 can be a fully sealed, backlit liquid crystal diode (LCD) display, or another display type suited for underwater operation. In some embodiments, if lift controller 102 is to remain above the surface and be connected to the valves and sensors via, for example, an extended length electrical or fiber optic data cable, or if the display is to be sealed inside the waterproof housing of lift controller 102, any suitable conventional display can be employed. In some embodiments, visual display 117, which is substantially similar to visual display 105, can be included on diver controller 107.

Diver control 107 can be included as part of lift controller 102, or be remotely connected to lift controller 102 via an electrical, optical, sonar, acoustic, radio frequency (RF), or other wired or wireless connection. Diver control 107 includes input controls that can be operated by a diver under water. Various embodiments include controls for controlling visual display 105, override controls for inflation valves 103 and deflation valves 104, and the like. Warning indicators, such as color changing lights, buttons, and the like can be included in diver control 107, as well as tactile warning indicators such as vibration transducers or sonic generators. The shape and construction of the diver interface can be varied according to industry standards or common practices, man-machine interface studies, user preferences, or the like.

Figure 2:
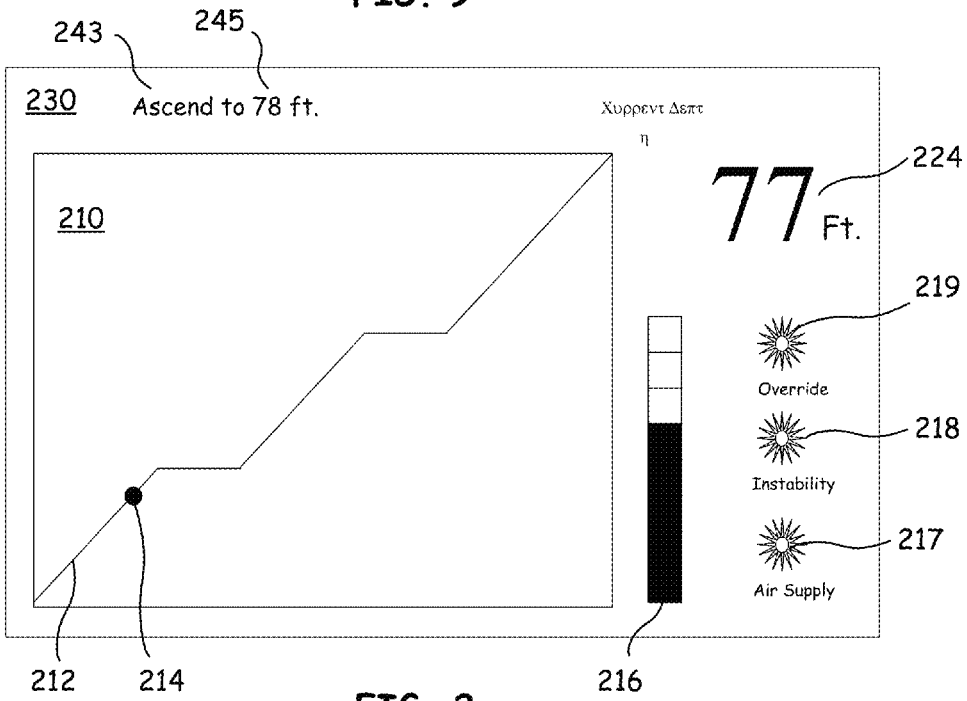
FIG. 2 is a front view of a representative lift-controller user interface, according to various embodiments of the disclosure.

FIG. 2 is a front view of a lift-controller user interface 230, according to various embodiments of the disclosure. Lift-controller user interface 230 shows a current mode 243 and target depth 245. As illustrated, the current mode is "Ascend", and the target depth is 78 ft. The current depth can be shown by depth indicator 224, and by current depth marker 214 on display screen 210. Depth marker 214 is illustrated as a point plotted on a graph 212, which is a line graph of a lift plan being executed. Note that in some embodiments, the portion of the lift represented by the part of graph 212 below current depth display 214 represents actual sensor reading taken during the lift, while the portion of the graph 212 above current depth display 214 represents a simulated lift plan. Current depth display can also be presented as a numerical value, as shown by current depth value 224.

In various embodiments, when the instability ratio is greater or equal to unity, the trajectory of the lifting system becomes unstable, and can no longer be controlled by inflation valve 103 and deflation valves 104. Instability meter 216 provides a graphic indication of the buoyancy-based lifting system's nearness to instability during real time operation. Instability meter 216 can display the actual instability ratio, e.g. 0.6, or some other indication of how near the system is to representation of the instability ratio. Although illustrated as a bar graph, other representations of instability meter 216 can be used in place of, or in addition to, the bar graph. For example, instability meter could be a physical or simulated analog dial or gauge, a series of pictorial representations, or any other useful display scheme.

In addition to instability meter 216, instability warning 218 further alerts the diver about the instability of the system. Other indicators can also be provided, indicator 219, which can be used to indicate that the diver has assumed manual control, and indicator 217, which can be used to alert the diver that the remaining gas supply is low. As previously noted, indicators 217, 218, and 219 could be visual, auditory, or tactile indicators.

Figure 3:
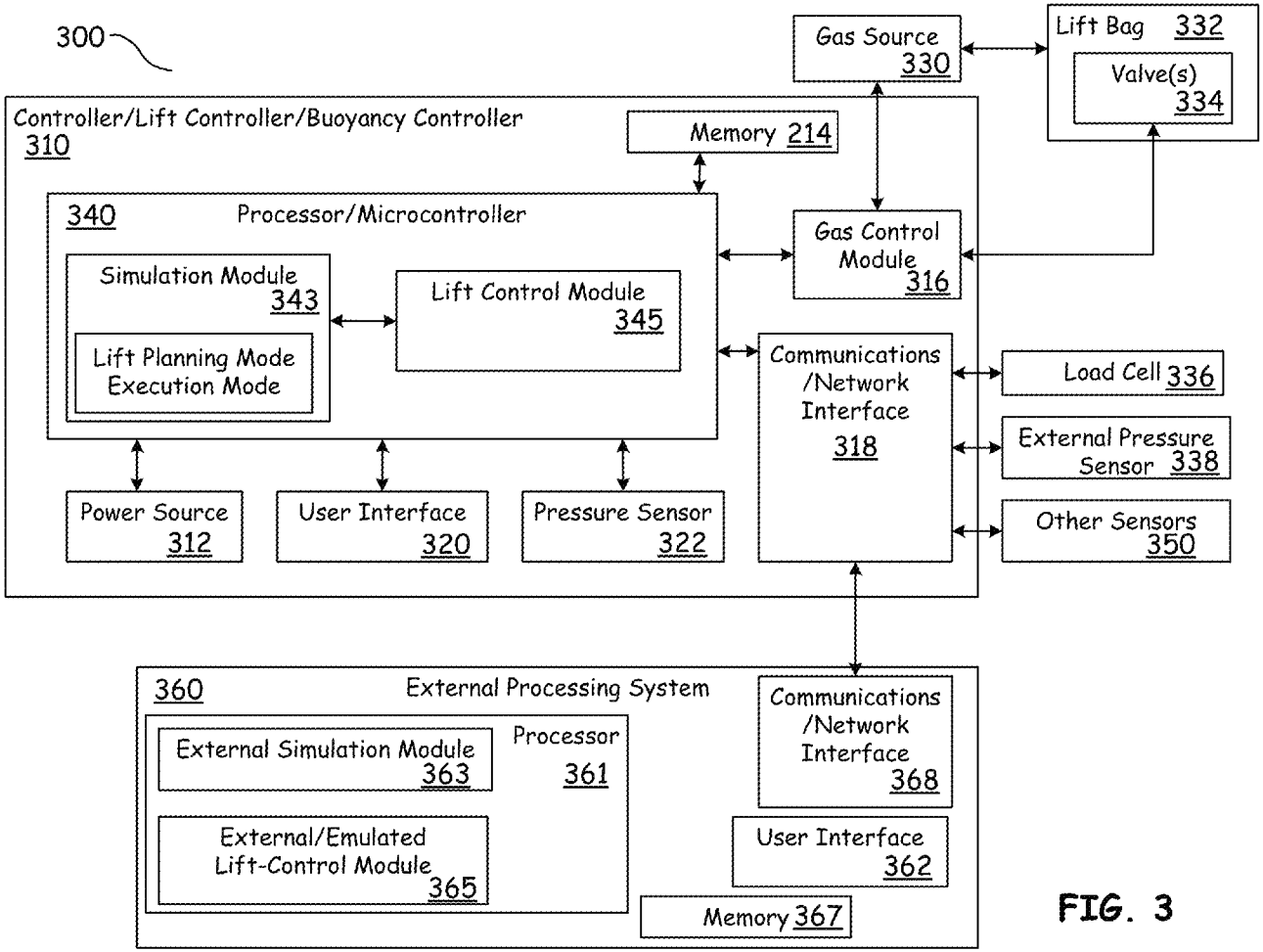
FIG. 3 is a block diagram of a representative buoyancy-based lifting system, according to various embodiments of the present disclosure.

FIG. 3 is a block diagram of a representative buoyancy-based lifting system 300, according to various embodiments of the present disclosure. System 300 includes lift-controller 310; external processing system 360; lift bag 332; gas source 330, which supplies gas at above ambient pressure to inflate lift bag 332; one or more valves 334, which are used to inflate or deflate lift bag 332; load cell 336; external pressure sensor 338; and other sensors 350. Some or all of these elements can be connected to lift-controller 310 at different stages of a lift, for example a planning and simulation stage, a calibration phase, and a lift execution phase.

Lift-controller 310 includes processor 340; memory 214, which can store a lift plan and data collected during a lift; gas control module 316, which controls valves 334 to inflate or deflate lift bag 332; communications interfaces 318; on-board pressure sensor 322; user interface 320, which can be integral to lift-controller 310, external to lift controller 310, or partially integrated and partially external; and power source 312, which can be a local power source carried by lift controller 310 or provided from an external source via a power connector. Processor 340 includes simulation module 343, which can operate in a lift planning mode and an execution mode, and lift control module 345.

Lift control module 345 provides control signals to valves 334 to control movement of system 300. In an example of operation, lift control module 345 receives data from pressure sensor 322, and in some cases load cell 336 and other sensors 350. Lift control module 345 can also access a lift plan stored in memory 214, and receive user input from user interface 320. Lift control module 345 applies a curve fitting algorithm to estimate the current state of the lift system, which can include a current instability ratio, and determines correct valve action to take based on the current state, the information retrieved from memory 214, and user input from user interface 320. The information retrieved from memory 214, or the user input received from user interface 320, can include a current command, which can in turn be used to determine a target state associated with that command. For example, a current command can be "Ascend 50 feet," and a target state associated with that command can be "Ascending with instability ratio threshold<=0.4." Another command may be "Ascend to [target] depth at constant rate," and the target state associated with that command could be "Ascending at X feet/second." If a command specified "Hold current depth for X minutes," the target state could be "Holding at depth X with variance of 0.5 feet." Other command and target state combinations are within the scope of the present disclosure. Processor 340, using lift control module 345, will open or close valves 334 to achieve the target state.

Simulation module 343 numerically models the physics of the lift bag system. For example, when system 300 is in the lift planning mode, simulation module 343 provides lift control module 345 with simulated pressure transducer data. In execution mode, simulation module 343 is used to predict the future trajectory of system 300, to predict impending instabilities, and to assess past performance.

External processing system 360 includes processor 361 configured to implement an external simulation module 363 and an emulated lift-control module 365, which can be used during a lift-planning stage in place of corresponding modules on-board lift controller 310. External processing system 360 also includes memory 367, a user interface 362, and communications/network interface 368. External processing system 360 can be implemented using a workstation, laptop, notebook, personal digital assistant, tablet, or any other computing device that has sufficient processing power and appropriate interfaces. In some embodiments, communications interface 318 and communications/network interface 368 each include wireless circuitry to enable wireless communications.

In at least one embodiment, external simulation module 363 and an emulated lift-control module 365 are used to plan a lift sequence before loading the system parameters, control parameters, and lift plan to memory 214 of lift controller 310. Once these parameters are loaded into memory 214, they can still be changed via the user interface 320. After a lift is completed, a history of the system's actual trajectory during the lift can be loaded back into memory 367 and analyzed.

Figure 4:
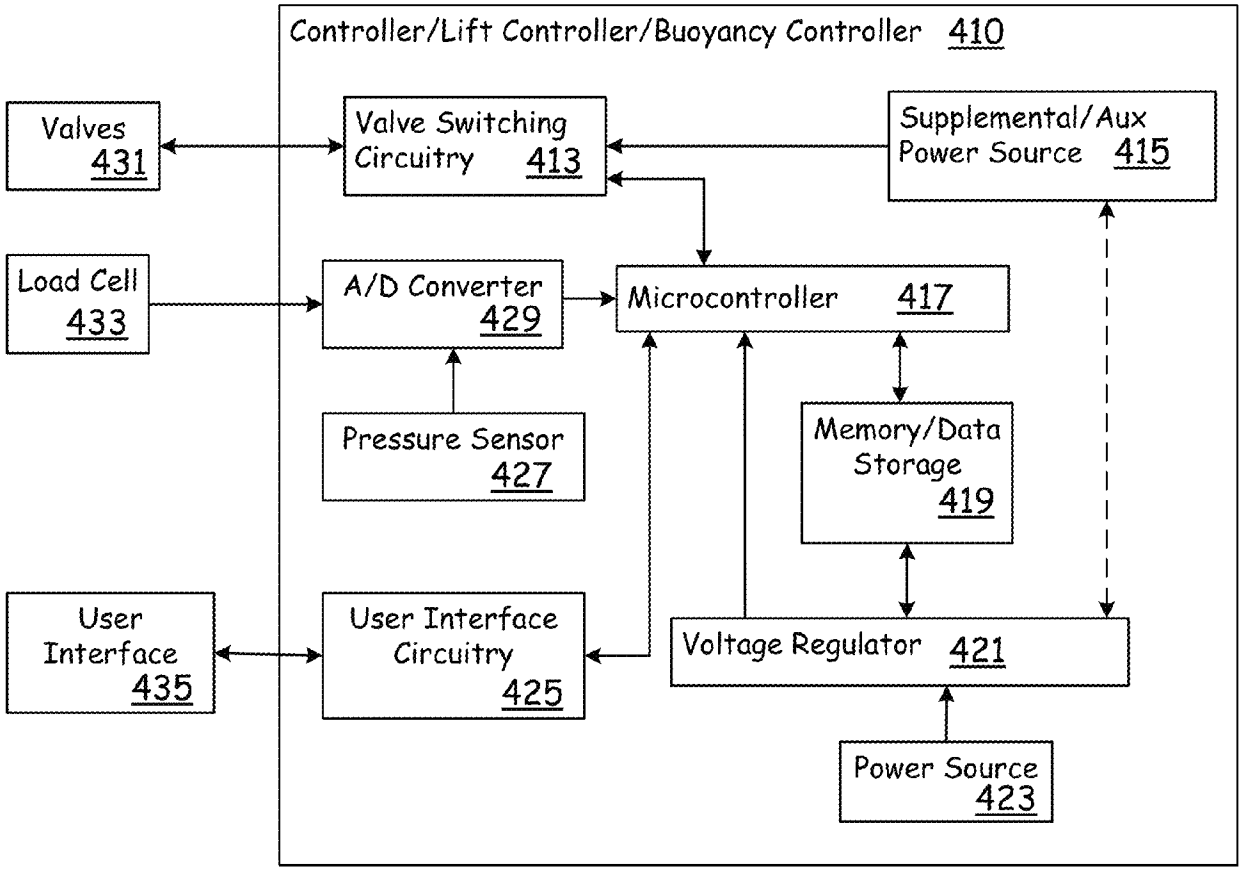
FIG. 4 is a block diagram of a representative lift-controller, according to various embodiments of the present disclosure.

FIG. 4 is a block diagram of a representative lift-controller 410, according to various embodiments of the present disclosure. Lift controller 410 includes valve switching circuitry 413 connected to valves 431; analog to digital (A/D) converter 429 connected to load cell 433 and pressure sensor 427; user interface circuitry 425 connected to user interface 435; microcontroller 417; memory 419; voltage regulator 421; power source 423; and supplementary power source 415.

Microcontroller 417 and memory 419 receive regulated power from voltage regulator 421, which in turn receives power from power source 423. In some embodiments, supplemental power source 415 can be used as an auxiliary or backup power source in the event that power source 423 fails. Generally, however, supplemental power source 415 is dedicated for use in powering valve switching circuitry 413. Note that if supplemental power source 415 fails, some embodiments allow power source 423 to provide backup power for valve switching circuitry 413.

Microcontroller 417 uses the digital signal output from A/D converter 429, and in some instances user input received from user interface circuitry 425, to simulate and control movement of a lifting system. A/D converter 429 receives analog signals from a pressure sensor such as on-board pressure sensor 427, and load cell 433, and converts the analog signal into digital pulses usable by microcontroller 417. Note that in other embodiments, microcontroller 417 can directly receive analog signals and convert them using on-chip A/D converter circuitry. In embodiments where pressure sensor 427 is implemented as a linear potentiometer stain gauge, A/D converter 429 can convert an analog voltage or current level to a serial binary value with 1, 2, 4, 8, 16, 32, or more bits representing each binary value. Microcontroller 417 can store the values in memory 419, and use the data to calculate a current instability ratio, estimate impending instabilities, predict future instability ratios, compare estimated and predicted instability ratios, compare actual lift parameters to lift parameters specified in a lift plan stored in memory 419, and the like.

Valve switching circuit 413 receives a low power control signal from the microcontroller, and amplifies it to supply sufficient current to drive the valves 431, which in the case of direct acting solenoid valves presents a larger inductive load. In at least one embodiment, valve switching circuit 413 is implemented using a Darlington Array to power a reed relay, which in turn powers valves 431. Other embodiments can be implemented using other configurations and types of switching circuitry and logic.

Memory 419 can be implemented as a combination of volatile and non-volatile memory, including electronically erasable programmable read only memory (EEPROMS), read only memory (ROM), flash memory, random access memory (RAM), dynamic random access memory (DRAM), static random access memory (SRAM), synchronous dynamic random access memory (SDRAM), secondary storage such as optical drives, magnetic disk drives, or the like. One suitable embodiment for the non-volatile memory is a USB Flash Drive. Because USB Flash Drives are a commercial standard, this choice enhances the universality of data transfer after a lift.

In at least one embodiment, memory 419 includes enough non-volatile memory to collect the complete trajectory of a lift, including actual sensor measurements made during the lift and a simulated lift trajectory. At least a portion of memory 419 should be selected to have read and write access times sufficient to prevent affecting other processor operations. In some instances, a queue can be implemented in a cache memory to handle temporary periods where write-speed of the memory has the potential to adversely impact other functions of microcontroller 417 or prevent storage of a complete set of sensor data obtained during a lift. Note that some embodiments can be implemented to save only a subset the sensor measurements. This is especially true where sensor data can be reconstructed by interpolating between saved measurements.

Voltage regulator 421 should be selected to have noise characteristics that do not interfere with the microcontroller's ability to estimate the system's state from the pressure transducer. For example, noise from voltage regulator 421 should not change the analog pressure voltages or currents generated by pressure sensor 427. It should also be noted that in FIG. 4, low current and high current circuits are powered by two separated batteries or power supplies 415 and 423 to reduce noise in the transducer from the high inductive spike. However, with ample filtering, use of separate power supplies is not necessary.

Figure 5A:
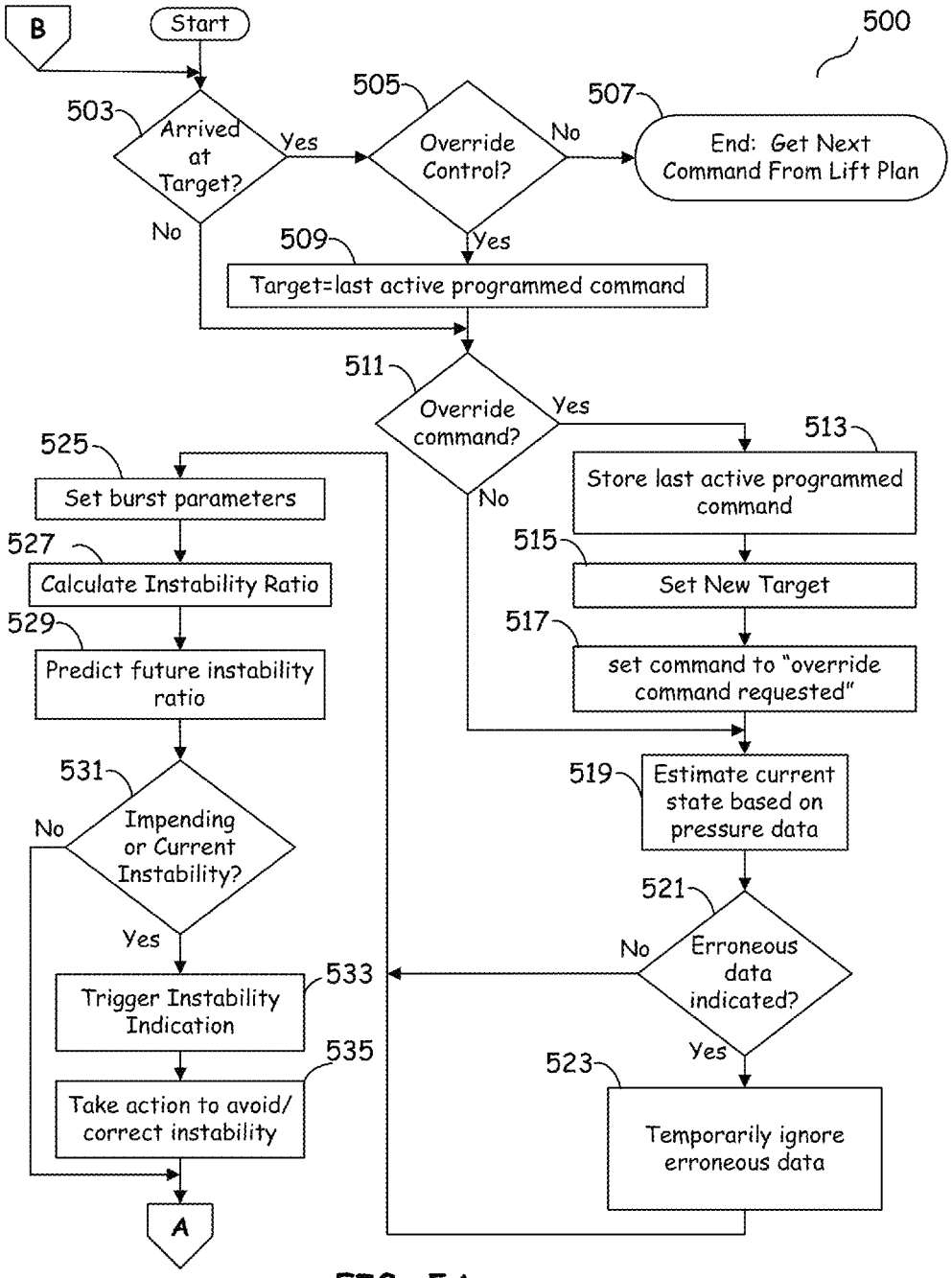
FIGS. 5A and 5B are flow charts illustrating a representative method according to various embodiments of the present disclosure.
Figure 5B:
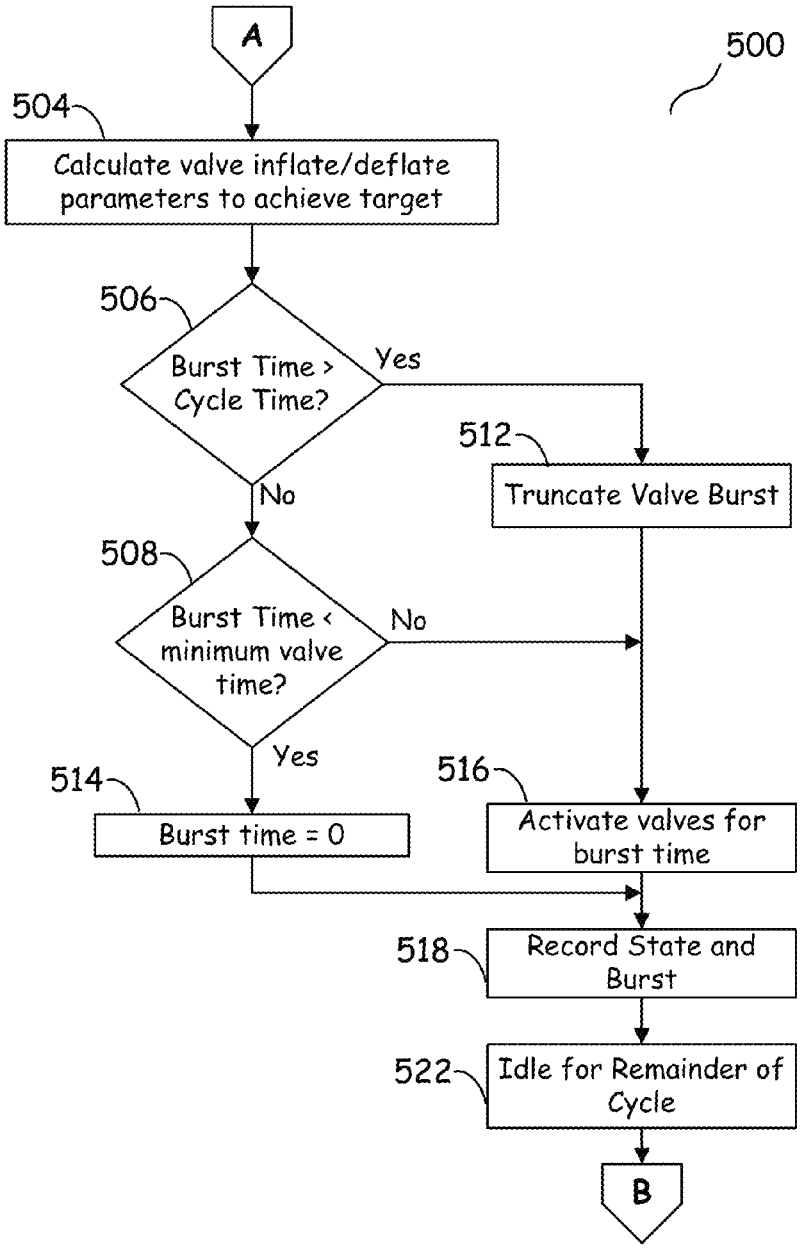

Referring next to FIGS. 5A and 5B, a method 500 is illustrated and discussed according to various embodiments of the present disclosure. Method 500 can be implemented by a special or general purpose processor configured for operation by a series of program instructions, by specially adapted discreet circuitry and logic, or a combination thereof. In at least one embodiment, method 500 can be implemented as a subroutine or software module that is called by a main program that includes a series of commands that can be included in a lift plan. When the command used to call method 500 has completed, the main program can call method 500 with a different command.

As illustrated by block 503, a check is made to determine whether the load being buoyantly lifted has arrived at a target specified by the current command. If load has not arrived at the target, method 500 proceeds to block 511. If the load has arrived at the target, the method proceeds to block 505. The target can be a target depth, a target ascent speed, a target descent speed, a target change in velocity, a target ambient pressure, or some combination of these or other targets.

If the load being lifted has arrived at the target, a check is made at block 505 to determine whether a user override control is active. If user override control is not active, then method 500 ends at block 507, by returning to a main program to obtain the next command from a lift plan. However, if the check at block 505 indicates that a user override control is active, the next command from the lift plan is not executed. Instead, the previously active target is maintained by setting the target equal to the target specified by the last active programmed command at block 509.

Put another way, the decision at block 505 determines whether method 500 looks to the lift plan for the next command, or whether the next command is to be obtained from the queue of commands from last override. Assume, for example, that a current command in the lift plan specifies that the load is to be held at 100 feet below sea level, and the next command specifies lifting the load to 90 feet below sea level at a rate of one foot per second. In the override mode, control is passed from the main program executing the lift plan to a user. The user then has the option of issuing an override command or maintaining the current command, thereby delaying or preventing execution of the next command. In this example, as illustrated by block 509, the target depth of 100 feet is maintained as the active target.

In various embodiments, an override command can be issued either within or outside of an override control mode, and a check to see whether an override control has been issued is performed at block 511. If an override command has been issued, the currently active command and target are stored at block 513, a new target corresponding to the override command is set at block 515, and the current command is set to "override command requested," as illustrated by block 517. Once the new target and command are set, method 500 proceeds to block 519.

If the check at block 511 indicates that no override command has been issued, an estimate of the current state of the load is made at block 519. Estimating the current state can include estimating current depth, instantaneous velocity, average velocity, instantaneous acceleration, average acceleration, direction of movement, and the like. This estimate can be made based exclusively on pressure measurements, or can be based on a combination of pressure measurements and other information obtained from sensors or other sources, such as accelerometers and the like.

In various embodiments, the current state is estimated from curve fit pressure data determined, for example, using a piecewise linear least-squares method. For example, the current state can be estimated, by applying a linear regression to 50 data points taken every 0.01 seconds directly prior to the state estimation. Some embodiments use an infinite impulse response (IIR) filter, followed by a least squares estimation over a set number of milliseconds. The data collected for this calculation can be obtained at a frequency greater than a cycle time of the system using an interrupt service routine to trigger and read an A/D converter connected to a pressure sensor.

The concept of the cycle time of the system is similar to the concept of a natural frequency of oscillation, except that buoyancy based lifting systems are inherently unstable, and so do not oscillate without external forces being applied. During the planning phase, an initial time can be selected by the simulation module from a look-up table generated by synthesizing simulated lifts. The cycle time is dependent on the size of lift bag, the number and type of valves, the drag of the system, the system's weight in water, and various other system parameters. In some embodiments, the cycle time is selected to be a function of the ratio of the system's drag (at critical velocity and at the surface)/Weight of the system in water. Note that the cycle time of the system when moving can be different than the cycle time when holding steady.

An optimal value of cycle time can be selected so that the frequency at which the upward or downward movement needs to be adjusted is within the physical capabilities of the valves being used. Optimum cycle times have been selected to be, in some embodiments, between 0.2 and 0.8 seconds. The cycle time should also be chosen so that the oscillations satisfy the instability ratio threshold. Thus, for example, the cycle time of the system should be selected so that the frequency at which the valves need to opened and closed does not tax the systems capabilities. The cycle time should also be selected so that the system does not pick up so much speed during a cycle that the system becomes unstable before the end of the cycle. In various embodiments, the final determination of cycle time comes from review of the simulated performance, and is adjusted either by the program or by the user, based on the acceptable level of oscillation.

At block 521, a check is made to determine whether the pressure data, or other data used appears to be erroneous to the point of being unusable. The determination about whether the data appears to be erroneous can be made based on input from one or more sensors reporting a malfunction, exaggerated swings in measurements, measurements that do not fall within a predetermined variation threshold from expected values, or the like. If the data does not appear to be erroneous, the method proceeds to block 525.

If the data appears to be erroneous, the data can be temporarily ignored until additional pressure data is received from a sensor, as illustrated by block 523. When the data is temporarily ignored, the control system can control the system based on previously received valid data, based on extrapolated data estimates, or based on simulated data obtained from the lift control plan. Note that if a sensor fails, and there is no backup sensor, the pressure data will remain erroneous, and a user can enter an override mode or assume manual control. In some embodiments, provisions can be made to connect a replacement sensor via a waterproof connection during a lift operation, or to use data from a wirelessly connected sensor that may be carried by the diver.

Valve burst duration, e.g. the amount of time inflation and deflation valves are to remain open, can be set at block 525. In some embodiments, parameters other than valve burst duration can be set or adjusted. A current instability ratio is determined at block 527, and a future instability ratio is determined at block 529. The instability ratio is a measure of the instability of the system. The current and future instability ratios can be used at block 531 to identify impending or current instabilities.

If the decision at block 531 indicates the instability ratio is above a certain threshold, is predicted by the simulation module to be above the threshold within a certain time interval, or shows exceptional sensitivity to parameters of which there is an inherent uncertainty, an instability indication can be triggered at block 533. If instability is imminent, automated corrective actions can be taken to avoid or correct the instability, as illustrated by block 535. Such changes could include increasing the target depth, decreasing the target velocity, activating or increasing the activation of inflation or deflation valves, and changing the cycle time. For example, if an impending or current instability is indicated at block 531, a visible, audible, or tactile warning can be given to the diver. At the same time, the inflation and deflation valves can be operated to change the trajectory.

Referring next to FIG. 5B, the discussion of method 500 continues. As illustrated by block 504, valve inflate/deflate parameters, such as valve open or close durations, can be set to reach the active target. A check of the valve durations can be made at block 506 to determine whether the burst time, i.e. the time the inflation or deflation valve is to remain open, is greater than the cycle time. If the burst time is longer than the cycle time, block 512 truncates the valve burst time to be no longer than the cycle time. In other embodiments, the valve is left running when the burst time is longer than the cycle time, and during the next program loop any additional valve operation time is added to the previous valve burst time. If block 506 determines that the burst time is not greater than the cycle time, a check is made at block 508 to determine whether the burst time is less than a minimum open or closed time of which the valve is capable. If the burst time is greater than or equal to the minimum valve time, as determined by block 508, or if the truncated valve burst time is established at block 512, the valves are activated for the appropriate burst times at block 516. Note that in some embodiments, if the burst time is less than the minimum valve time, the burst time is set to zero by block 514, and no burst is performed. In other embodiments, all valve burst times are added to a counter, regardless of duration, and the counter is decremented whenever a valve is opened. Thus, the burst times are continually updated by adding or subtracting from a counter.

At block 518 the valve burst times and the state of the lifting system are recorded, and method 500 idles for the remainder of the cycle, as illustrated by block 522. In various embodiments, the valves and sensors are run using different processes, so the process is not idled while the valve is actuated and the sensor states are updated.

Figure 6A:
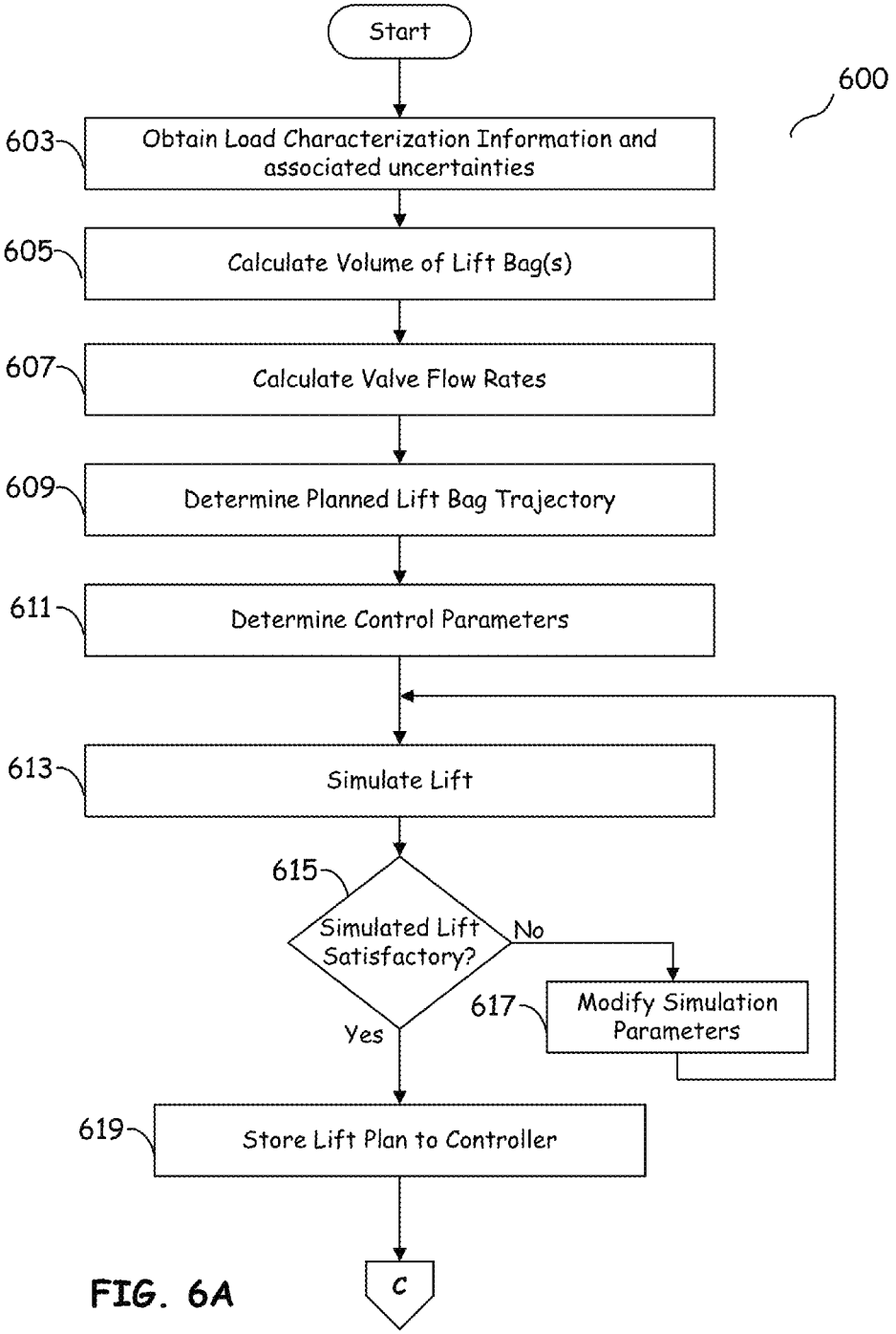
FIGS. 6A and 6B are flow charts illustrating a representative method according to various embodiments of the present disclosure.
Figure 6B:
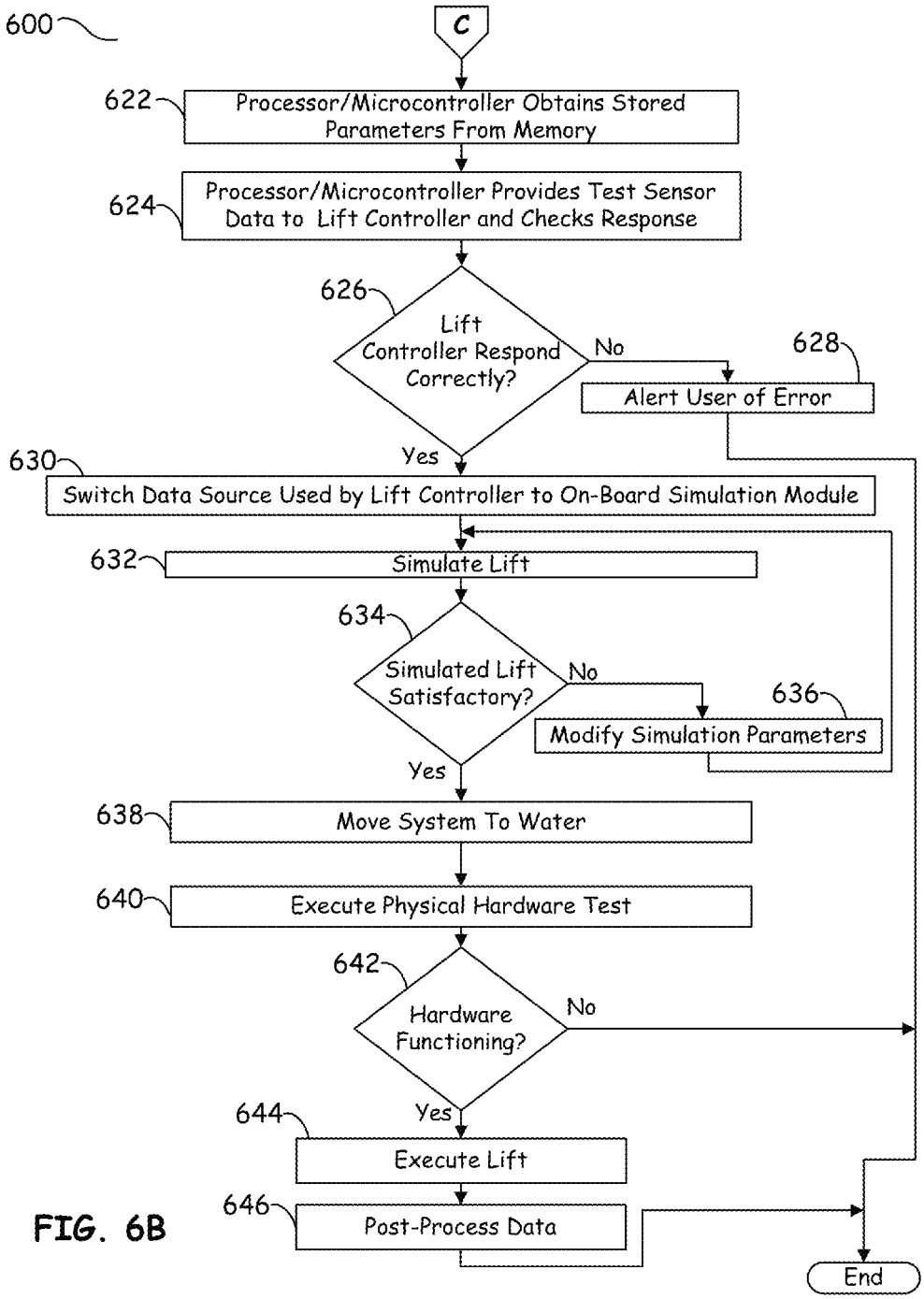

FIGS. 6A and 6B are flow charts illustrating a method 600 for planning and execution processes for various embodiments of the present disclosure. As illustrated by block 603, load characterization information and associated uncertainties are determined. This includes obtaining estimates of depth, mass, displacement, drag area, coefficient of drag, and their associated uncertainties for the object to be lifted. As illustrated by block 605, the volume of the lift bag to be used during the lift is determined. The volume of the lift bag can be calculated based on the maximum velocity at which the bag is to be controlled, and the load characterization parameters. A static volume of the lift, which refers to a fixed quantity of buoyancy added to the lift system to make up some or most of the load to be lifted, thereby allowing a smaller controlling lift bag to be used and allowing for more stability, can be derived from the second order differential equation, such that:

$$\text{Static volume} = \frac{(1-\sigma_m)*m*g}{\gamma} - (1+\sigma_{displacement})*\text{displacement} - \frac{(1+\sigma_{C_d})*(1+\sigma_A)*C_d*A*\rho*\left(\frac{dy}{dt}\right)^2}{2*\gamma} \quad \text{Eqn. 1}$$

where σ is the uncertainty of the size and weight of the object to be lifted

By a similar means the dynamic volume is estimated to be:

$$\text{Dynamic volume} = \frac{2*m*g*\sigma_m}{\gamma} + 2*\sigma_{displacement}*\text{displacement} + \frac{(1+\sigma_{C_d})*(1*\sigma_A)*C_d*A*\rho*\left(\frac{dy}{dt}\right)^2}{\gamma} \quad \text{Eqn. 2}$$

Specific lift bag sizes appropriately sized for the lift operation can then be selected based on currently available lift bag sizes, such that the volume of the static bag(s) should be at most the value given by Eqn. 1, and the total volume (static plus dynamic) should be at least the total of static and dynamic given above by Eqns. 1 and 2. Selecting the lift-bags as disclosed herein helps ensure that the lifting system is capable of achieving the maximum control velocity set out by the user.

As illustrated by block 607, valve flow rates can be calculated. The stability (instability) ratio, which is derived and discussed in greater detail below, can be written as:

$$R_s = \frac{vV}{K_v z} \quad \text{Eqn. 3}$$

where $K_v$ is the characteristic valve flow rate constant. Eqn. 3 compares the change in volume of the bag due to change in depth to the valve capacity, and at the point of instability, where $R_S=1$, Eqn. 3 can be solved for the valve flow rate needed to balance the change in volume of the lift bag at critical velocity, which yields:

$$K_v = \frac{vV}{z}.$$

Phrased another way, solving the instability ratio formula for the valve constant, allows the valve flow rate to be defined in terms of a system state on the edge of the instability space. The natural choice for this state is a depth of zero feet because the system is most unstable at shallow depths, and because we want the system to be controllable all the way to the surface, and the maximum controllable velocity defined by the user. In some embodiments, the system can advise the user if a given velocity cannot be achieved within available parameters and accordingly limits the user's choice of maximum velocity. Using this equation, the system can suggest the valve flow rates for the lift.

The values for which constant velocity can be achieved are bounded by the critical velocity of the system, and minimum velocity determined by the least possible valve-open duration. Beyond the critical velocity, the system's valves cannot counter-act the expansion/contraction of the bag due to change in depth. a minimum velocity parameter related to the minimum valve-open duration by:

$$\text{Minimum Constant Velocity} = \frac{(\tau_{min} * k * \gamma * \Delta t_{arrive})}{m}.$$

Velocities outside of these bounds cannot be controlled, and the system contains checks to ensure that a command with a velocity outside these bounds is not attempted.

As illustrated by block 609, a planned lift bag trajectory, which is part of the lift plan, is determined. In some embodiments, the planned lift bag trajectory is determined by obtaining user inputs defining a sequence of mode commands that make up the lift operation. A sequence of mode commands can include, for example, commands to descend, commands to ascend, commands to maintain a particular depth. The commands can also include implicit or explicit target values for velocity, acceleration, ambient pressure, timing, or the like. The commands obtained during execution of block 609 can be transferred to and stored in the lift controller once they become finalized.

As illustrated by block 611, control parameters for the lift, which are included in some embodiments of a lift plan, are determined. As illustrated by block 613, the lift is simulated. In various implementations an external simulation module and an emulated lift control module running on a personal computer or other computing device outside of the lift controller can be used to simulate the commands included in the planned lift bag trajectory. Expected or default values of some or all system parameters, as well as a locus of other simulations in which the system parameters vary within uncertainties defined by the user, can be used during the simulation.

As illustrated by block 615, results of the simulation are checked to ensure that the lift plan is satisfactory. In certain embodiments, the system will simply not let a user program a lift that will not work. A lift plan can be considered to be unsatisfactory if, during simulation, the lift becomes unstable or approaches an instability ratio of unity, or some pre-set lower value, for example 0.80. A lift plan is also considered unsatisfactory if the position of the object cannot be maintained within the desired limits, or if the velocity of ascent or descent exceeds a desired value, even if the lift remains stable.

As illustrated by block 617, if the simulated lift is not satisfactory, the simulation parameters can be modified, and the simulated lift can be repeated as illustrated at block 613. If control parameters or the sequence of mode commands must be changed, there are many ways of achieving this. In one embodiment, one or more parameters can be varied over a fixed range, and the trajectories plotted to determine the correct parameter value. In other embodiments, each simulation can be evaluated on the basis of a success criterion, and the criterion can be plotted as a function of the parameter to determine the optimal parameter value. In at least one embodiment, this process is iteratively repeated until all cases within the uncertainty bounds produce acceptable results.

As illustrated by block 619, once satisfactory results are achieved, the lift sequence, also referred to as a lift plan, is moved to memory on-board the lift controller.

When the lift controller is powered on, a systems check can be performed using an external processing system. As illustrated by block 622, when the processor included in the lift controller is powered on, the processor can read into volatile memory the system parameters, lift parameters, and other portions of the lift plan created during the simulation by the external processing system. As illustrated by block 624, the external processing system can provide the lift controller with a series of pressure readings, or other data, to which the lift controller should provide a known response.

At block 626 a check is performed to determine whether the lift control module responded appropriately. In various embodiments, the actual response of the lift control module will be compared to an expected response to confirm that the lift control module is functioning properly. In some embodiments, known false data can be provided to ensure proper response to incorrect or failure-related data. If the check at block 626 fails, that is if the check indicates a malfunction, a user is notified of the error at block 628, and method 600 ends.

In some embodiments, an on-board systems test can be performed, which allows confirmation that all of the system parameters, lift parameters, and lift plan were correctly stored in the memory of the lift controller. As illustrated by block 630, the data source is switched to the on-board simulation module, which provides an artificial simulated pressure signal, with or without other simulated sensor signals, to the lift control module on board the lift controller, to simulate, as illustrated by block 632, the entire lift. The trajectory of the simulation can be made available to the user via the user interface.

As illustrated by block 634, a check is made to determine if the simulation is satisfactory. In some embodiments the simulation must be approved before the lift controller proceeds, and the system is moved to the water at block 638. If the simulation is not approved, parameters may be changed and the simulation may be re-run, as illustrated by block 636. This iterative process continues until the simulation meets the user's criterion. In practice it is unlikely that iterations will be performed at this point, because the simulation has already been run using an external processing system. However, iterations may be required in some embodiments, and can be run for verification purposes.

As illustrated by block 640, the lift controller can execute a physical hardware test, and upon approval at block 642, the system will be ready to execute the lift, as illustrated by block 644. If, at block 642, the hardware is determined to be malfunctioning, method 600 terminates. After the lift, as illustrated by block 646, the data of the system's trajectory during the lift can be available for viewing on both the onboard user-interface and on an external processing system.

FIG. 7 is a graph illustrating simulated data from the lift confirmation stage, plotted on the same graph as actual lift data for the same system parameters, lift parameters, and lift plan. The graph shows that the simulator is a good predictor of what will happen in real execution. This allows the user to have confidence in the simulation as a means of predicting the real execution.

FIG. 8 is an expanded view of the "Hold Depth" section of FIG. 7. Notice that the bag does not drift more than 0.5 ft from the target depth. In at least some embodiments, it is believed that better than 1-ft amplitude of oscillation can be achieved with substantially any lift bag configuration. The maximum value on the secondary vertical axis of the graph is set to the cycle time of the loop within the Control Module. This graph therefore shows that the Control Module, uses very little air.

FIG. 9 shows the flow rate through a deflation valve with respect to weight in water 904 applied to a flexible lift bag, according to at least one embodiment of the present disclosure. The deflation valve is equipped with a direct acting solenoid. Notice that the relationship between the flow rate and the weight in water varies dynamically with the amount of air in the bag, and the lift control module is configured to account for that variability.

Derivations

The following mathematical derivations support the disclosed techniques, methods and devices.

Equilibrium of Forces

The motion of the lift bag is governed by Newton's Second Law in its familiar formulation of force equals mass times acceleration:

$$F=ma \qquad \text{Eqn. 4:}$$

where F is the force, m is mass, and a is acceleration. The summation of forces on the lift bag system in the vertical (Y) direction, results in $$ma=+mg-B-D \qquad \text{Eqn. 5:}$$

where B is the buoyancy force, mg is the gravity weight (total mass of the lift bag system including the load to be lifted), and D is the drag.

Define buoyancy in terms of the time and depth-dependent volume of the lift bag plus the volume-displacement of the load to be lifted, times the unit weight of water, γ:

$$B = \gamma(v(Y, t) + v_{load}) \qquad \text{Eqn. 6}$$

$$D = \text{sign}(V)\frac{1}{2}\rho A_d C_d V^2 \qquad \text{Eqn. 7}$$

Substituting Eqn. 6 and Eqn. 7 into Eqn. 5 yields:

A sign(V) term is needed because the drag force always opposes the direction of motion. In our sign convention, depth, velocity, and acceleration are all positive in the downward direction.

$$a = \frac{(\text{mg} - \gamma v_{load}) - \gamma v(Y, t) - \text{sign}(V)\frac{1}{2}\rho A_d C_d V^2}{m} \qquad \text{Eqn. 8}$$

Velocity and acceleration are defined by the time-derivatives of Y, $$V = \frac{dY}{dt}$$

$$a = \frac{dV}{dt} = \frac{d^2Y}{dt^2}$$

Substituting these definitions into Eqn. 8 gives:

$$\frac{d^2Y}{dt^2} = \frac{(\text{mg} - \gamma v_{load}) - \gamma v(Y, t) - \text{sign}(V)\frac{1}{2}\rho A_d C_d\left(\frac{dY}{dt}\right)^2}{m} \qquad \text{Eqn. 9}$$

This is a nonlinear second order differential equation governing the vertical ascent and descent of a lift-bag system. The first term on the right hand side is the net weight in water of the load to be lifted and is considered a constant. The middle term, γv(Y,t), is the buoyancy of the lift bag, which contains two components: the variation in volume due to depth change, and the time-dependent control function for varying the amount of gas in the bag. The last term, drag, is the damping in the system.

To put this equation into a simpler form we can use several convenient substitutions:

$$z = Y + \frac{p_{surf}}{\gamma}$$

where $p_{surf}$ is the atmospheric pressure.

$$\beta = \frac{(\text{mg} - \gamma v_{load})}{m}$$

$$\zeta = \frac{\frac{1}{2}\rho A_d C_d}{m}$$

$$D = m\zeta\left(\frac{dz}{dt}\right)^2$$

Resulting in:

$$\frac{d^2z}{dt^2} = \beta - \frac{\gamma}{m}v(z, t) - \zeta\text{sign}\left(\frac{dz}{dt}\right)\left(\frac{dz}{dt}\right)^2 \qquad \text{Eqn. 10}$$

Now consider the volume change of the gas in the lift bag. The ideal gas law is written:

$$pv=nRT \qquad \text{Eqn. 11:}$$

where p is the absolute pressure of the gas, v is the volume of the gas, n is the number of moles of gas, R is the universal gas constant, and T is the absolute temperature. We can then state that the instantaneous pressure and volume of the gas in the lift bag are related directly to the pressure and volume of the same quantity of gas at the surface:

$$\left(\frac{pv}{p_{surf}v_{surf}}\right) = \frac{T}{T_{surf}} \qquad \text{Eqn. 12}$$

where $p_{surf}$ is the atmospheric pressure at the surface (normally 1 atm or 14.7 psi), and $v_{surf}$ is the volume of the same mass of gas in v as if it were at the surface.

Because the lift-bag is made of flexible material, the gas pressure, p, in the lift bag is approximately the same as the ambient water pressure, which increases linearly with depth:

$$p=p_{surf}+\gamma Y=\gamma z$$

Combining with Eqn. 9 and solving for v:

$$v = \frac{p_{surf} v_{surf}}{\gamma z}\left(\frac{T}{T_{surf}}\right) \quad \text{Eqn. 13}$$

The temperature term in the equations is near unity for most normal lifts in ocean depths of 200-ft or so. In lakes, where thermal gradients are stronger, the temperature term could have up to a 10% effect on performance. In some embodiments, the temperature effect will be neglected.

Now, to allow the volume of gas in the bag to vary with time, via a set of control valves, we can write the total derivative of v with respect to time as:

$$\frac{dv}{dt} = \frac{\partial v}{\partial z}\frac{dz}{dt} + \frac{\partial v}{\partial v_{surf}}\frac{dv_{surf}}{dt} \quad \text{Eqn. 14}$$

Where the first term represents the rate of change of volume with depth, and the second term represents the time-rate-of-change in the volume in the bag as produced by the control valves. Note that the surface volume $v_{surf}$ is a function of time. Taking the partial derivative of Equation 10 with respect to z gives:

$$\frac{\partial v}{\partial z} = -\frac{p_{surf} v_{surf}}{\gamma z^2} = -\frac{v}{z} \quad \text{Eqn. 15}$$

$$\frac{\partial v}{\partial v_{surf}} = \frac{p_{surf}}{\gamma z} \quad \text{Eqn. 16}$$

Because the volume in the bag is also changing as a function of valve deflation and inflation, the surface volume is obtained by integration over time:

$$v_{surf} = v_{surf_0} + \int \frac{\gamma z}{p_{surf}}\left(\frac{\partial v}{\partial t}\right)dt \quad \text{Eqn. 17}$$

Putting this into discrete form by summing over time steps i=1 . . . n, gives:

$$v_{surf_n} = v_{surf_0} + \sum_{i=1}^{n} \frac{\gamma z_i}{p_{surf}}\Delta v_i \quad \text{Eqn. 18}$$

In the simple case where there is no gas being added or subtracted from the lift bag after the initial inflation at i=1, then $v_{surf}$ is a constant, and v is evaluated in Equation 10 only as a function of the depth of the bag. It can be shown that the total rate of change of $v_{surf}$ with respect to time is equal to the partial derivative of the volume with respect to time:

$$\frac{dv_{surf}}{dt} = \frac{\partial v}{\partial t} \quad \text{Eqn. 19}$$

Combining Eqns. 14, 15, 16, and 19 gives $$\frac{dv}{dt} = -\left(\frac{v}{z}\right)\frac{dz}{dt} + \frac{\partial v}{\partial t} \quad \text{Eqn. 20}$$

Equation 20 is an expression for the total derivative of volume with respect to time and is used in the following section to derive other important formulas for the control of the lift bag.

Control Algorithm

In this section we derive the control algorithm from the fundamental equations above. The motion of the lift bag is controlled by discrete bursts of the inflation and deflation valves. To estimate the duration of the inflation or deflation bursts that will most effectively control the lift bag, consider the time-derivative of the acceleration as applied to Eqn. 7:

$$\frac{da}{dt} = \frac{d}{dt}\left[\beta - \frac{\gamma}{m}v(z, t) - \zeta\,\mathrm{sign}(V)V^2\right] \quad \text{Eqn. 21}$$

$$\frac{da}{dt} = \frac{d\beta}{dt} - \frac{\gamma}{m}\frac{dv}{dt} - \frac{d}{dt}(\zeta\,\mathrm{sign}(V)V^2) \quad \text{Eqn. 22}$$

Because β is a constant for the lift configuration, its derivative is zero. Also, we have previously found the expression for the total derivative of the volume as expressed in Eqn. 20. We can solve for the change in volume of the bag:

$$\frac{da}{dt} = -\frac{\gamma}{m}\left(-\frac{v}{z}V + \frac{\partial v}{\partial t}\right) - \frac{d}{dt}(\zeta\,\mathrm{sign}(V)V^2) \quad \text{Eqn. 23}$$

Solving for $\frac{\partial v}{\partial t}$ gives $$\frac{\partial v}{\partial t} = -\frac{m}{\gamma}\left[\frac{da}{dt} - \frac{\gamma}{m}\frac{v}{z}V + \frac{d}{dt}(\zeta\,\mathrm{sign}(V)V^2)\right] \quad \text{Eqn. 24}$$

We now define:

$$\frac{\partial v}{\partial t} = K_v f(t)$$

$$-1 \le f(t) \le 1$$

Here, f(t) is the volume control function that describes the valve flow, and $K_v$ is the flow rate of the valve (inflation or deflation). The function f(t) is positive for inflation and negative for deflation. It may be defined piecewise; e.g., a series of delta functions. We define $K_v$ to represent the characteristic valve flow rates of the respective inflation and deflation valves. The inflation and deflation valves have flow-rate characteristics which are a function of the specific valve design. Inflation rates are not substantially affected by depth if the regulator valve delivers a constant pressure over ambient, as is the case for scuba first-stage regulators. However, deflation rates vary as a function of the load and the shape of the bag.

Solving for f(t)

$$f(t) = -\frac{m}{K_v\gamma}\left[\frac{da}{dt} - \frac{\gamma}{m}\frac{v}{z}V + \frac{d}{dt}(\zeta\text{sign}(V)V^2)\right]$$

The value $f(t)$ can vary from −1 to 1.

Now, taking the remaining derivatives to be approximated by finite differences, we can obtain:

$$\tau = f(t)\Delta t = -\frac{m}{K_v\gamma}\left[\Delta(a) - \frac{\gamma}{m}\frac{vV}{z}\Delta t + \Delta(\zeta\text{sign}(V)V^2)\right] \quad \text{Eqn. 25}$$

$$\Delta(a)=a_n-a_{n-1} \quad \text{Eqn. 26:}$$

as a standard backward difference, and similarly $$\Delta(\zeta\text{sign}(V)V^2)=\zeta([\text{sign}(V_n)V_n^2-\text{sign}(V_{n-1})V_{n-1}^2] \quad \text{Eqn. 27:}$$

For the acceleration terms, the conventional second-order difference equation gives:

$$a_n = \left[\frac{(z_{n+1}-z_n)}{(t_{n+1}-t_n)} - \frac{(z_n+z_{n-1})}{(t_n-t_{n-1})}\right]\Big/(t_{n+1}-t_{n-1}) \quad \text{Eqn. 28}$$

$$a_{n-1} = \left[\frac{(z_n-z_{n-1})}{(t_n-t_{n-1})} - \frac{(z_{n-1}+z_{n-2})}{(t_{n-1}-t_{n-2})}\right]\Big/(t_n-t_{n-2})$$

Where n is the current position of the bag, and n+1 represents the next time step. We can choose to let the desired or target position occur at n+1:

$$z_{target} = z_{n+1} \quad \text{Eqn. 29}$$

$$\Delta t_{target} = (t_{n+1}-t_n)$$

$$\Delta t_n = (t_n - t_{n-1})$$

$$V_n = \frac{z_n - z_{n-1}}{t_n - t_{n-1}}$$

establishes a control feature in the equation. Using these expressions in Equation 28, we find that the current acceleration can be approximated by:

$$a_n = \frac{[(z_{target}-z_n) - V_n\Delta t_{target}]}{\Delta t_{target}(\Delta t_{target}+\Delta t_n)} \quad \text{Eqn. 30}$$

And the previous acceleration can be calculated directly from the finite difference formula using appropriately smoothed or filtered values of depth from the transducer. This is an estimation of the acceleration required to bring the lift bag directly to the target depth from its last position.

$$\tau_{burst} = -\frac{m}{K_v\gamma}\left[\frac{[(z_{target}-z_n) - V_n\Delta t_{target}]}{\Delta t_{target}(\Delta t_{target}+\Delta t_n)} - a_{n-1} - \frac{\gamma}{m}\frac{vY}{z}\Delta t + \Delta(\zeta\text{sign}(V)V^2)\right] \quad \text{Eqn. 31}$$

Eqn. 31: can be converted to an increment of volume (burst) by multiplying by the valve flow rate constant, $K_v$:

$$v_{burst} = -\frac{m}{\gamma}\left[\frac{(z_{target}-z_n) - V_n\Delta t_{target}}{\Delta t_{target}(\Delta t_{target}+\Delta t_n)} - a_{n-1} - \frac{\gamma}{m}\frac{vV}{z}\Delta t + \Delta\zeta\text{sign}(V)V2\right. \quad \text{Eqn. 32}$$

where $\Delta t_{target}$ is an estimate of the time expected to reach the target, and $K_v$ is the flow rate of the inflation valve or deflation valve.

Eqn. 32 is the general control function for a flexible lift-bag. As used in our invention, the formula takes various forms in which some of the terms, such as drag, may be more or less important under certain conditions. However, note the presence of the term $$\frac{\gamma}{m}\frac{vV}{z}\Delta t$$

inside the brackets. When multiplied through by the coefficients $$\frac{m}{\gamma K_v}$$

it becomes identically the instability ratio, $R_s$ described in the next section. This is an important consequence and highlights the practical role of this nondimensional instability parameter in the control module of the invention.

Note also that this important term in the control formula depends on quantifying the volume in the lift bag. It is an important aspect of the present invention that the control be achieved without resorting to attempts to directly measure the volume, or compute from an accumulation of volume flow measurements. This is because such measurement or accumulation of measurements would have to be unreasonably precise for flexible lift bags in order to obtain the level of control which the invention is capable of achieving by other means.

Thus, we turn to suitable approximations that are incorporated in our system, eliminating the need for direct measurement of the volume in the lift bag. For the case of equilibrium motion (no acceleration), the volume in the bag can be estimated from Eqn. 7 as:

$$v = \frac{m}{\gamma}[\beta - \zeta\text{sign}(V)V^2] \quad \text{Eq. 33}$$

And for the case of low velocity, i.e., 'hold-depth' mode, the drag is small, and the equation for volume can be suitably represented as constant:

$$v \cong \frac{m}{\gamma}\beta \quad \text{Eqn. 34}$$

These expressions are sufficiently accurate to achieve a high level of control. Note again that this estimate of volume is now treated as a constant parameter of the system (lift bag(s) plus load) and is thus does not have to be recomputed during the lift.

So, for example the control formula for low-drag equilibrium motion would be:

$$\tau = -\frac{m}{\gamma K_v}\left[\frac{(z_{target} - z_n) - V_n \Delta t_{target}}{\Delta t_{target}(\Delta t_{target} + \Delta t_n)} - a_n - \frac{\beta V}{z}\right]$$

Critical Velocity & the Instability Ratio

In this section we derive the formula for the critical velocity—the velocity above which the control valves can no longer compensate for the changes in volume as the lift bag moves through the water column. As stated previously in Eqn. 13 and 14, and neglecting temperature effects, the function for the instantaneous volume of the bag based on depth:

$$v = \frac{p_{surf} v_{surf}}{\gamma z}$$

and the expression for the rate-of-change of volume with depth:

$$\frac{\partial v}{\partial z} = -\frac{v}{z} \qquad \text{Eqn. 35}$$

$$\frac{dv}{dt} = -\frac{v}{z}V + \frac{\partial v}{\partial t}$$

Eqn. 35 contains effect of the control valves. The valves (both deflation or inflation) will change the volume in the bag according to their flow capacity:

$$\frac{\partial v}{\partial t} = K_v f(t) \qquad \text{Eqn. 36}$$

Mathematically, the condition of stability of a flexible lift-bag, which occurs at neutral buoyancy, requires that the volume of the bag can be increased or decreased regardless of motion. This equilibrium requirement is expressed by setting the derivative to zero in Equation 32:

$$\frac{dv}{dt} = 0 = -\frac{v}{z}V + K_v f(t) \qquad \text{Eqn. 37}$$

$$-1 \le f(t) \le 1$$

$$f(t) = \frac{vV}{K_v z} = \frac{p_{surf} v_{surf}}{K_v z^2}\frac{dz}{dt}$$

The point where $f(t)$ is equal to unity gives the condition for which the change in volume of the bag is exactly matched by the flow rate of the valve. This is the point of instability because the valves can no longer counter the changes in volume of the lift bag as it moves up or down the water column.

We define the instability ratio, $R_s$, which compares the change in volume of the bag due to change in depth to the valve capacity.

$$R_s = \frac{vV}{K_v z}$$

Eqn. 37 can be solved for the velocity at which instability occurs and at which the lift-bag system cannot be controlled. We term this the critical velocity:

$$V_{crit} = \frac{K_v z}{v} \qquad \text{Eqn. 38}$$

Eqn. 37 can be interpreted as the percentage of the total valve capacity required to hold the volume of the bag constant during ascent or descent. Alternatively, it can be understood as the ratio of the instantaneous velocity to the critical velocity: $V/V_{crit}$ Departure of the bag into irrecoverable ascent or descent occurs when $R_s$ exceeds a value of one. The equation represents an important nondimensional parameter of the lift bag, which is used in our system to set the boundaries of instability and to warn the diver or dive planner of potential instability. It is independent of the control system, and even applies to a manually-controlled bag.

The first and second derivatives of the instability ratio with respect to time can be used to anticipate instability. Beginning with the first derivative:

$$\frac{dR}{dt} = \frac{\partial R}{\partial z}\frac{dz}{dt} + \frac{\partial R}{\partial V}\frac{dV}{dt} + \frac{\partial R}{\partial v}\frac{dv}{dt}$$

$$\frac{dR}{dt} = -\frac{v}{K_v z^2}V^2 + \frac{v}{K_v z}\frac{dv}{dt} + \frac{V}{K_v z}\left(-\frac{v}{z}V + \frac{\partial v}{\partial t}\right)$$

$$\frac{dR}{dt} = \frac{vV}{K_v z}\left[-\frac{2}{z}V + \frac{1}{V}\frac{dV}{dt} + \frac{1}{v}\frac{\partial v}{\partial t}\right]$$

$$\xi = -\frac{2}{z}V + \frac{1}{V}\frac{dV}{dt} + \frac{1}{v}\frac{\partial v}{\partial t}$$

$$R' = R\xi$$

$$R'' = R[\xi^2 + \xi']$$

$$\xi^2 = \frac{4}{z^2}V^2 + \frac{1}{V^2}\left(\frac{dV}{dt}\right)^2 - \frac{4}{z}\frac{dV}{dt} - \frac{4}{vz}V\frac{\partial v}{\partial t} + \frac{1}{v^2}\left(\frac{\partial v}{\partial t}\right)^2 + \frac{2}{vV}\frac{\partial v}{\partial t}\frac{dV}{dt}$$

$$\xi' = \frac{2}{z^2}V^2 - \frac{1}{V^2}\left(\frac{dV}{dt}\right)^2 - \frac{2}{z}\frac{dV}{dt} + \frac{1}{V}\frac{d^2V}{dt^2} + \frac{1}{vz}V\frac{\partial v}{\partial t} - \frac{1}{v^2}\left(\frac{\partial v}{\partial t}\right)^2 + \frac{1}{v}\frac{\partial^2 v}{\partial t^2}$$

$$R'' = R\left[\frac{6}{z^2}V^2 - \frac{6}{z}\frac{dV}{dt} - \frac{3}{vz}V\frac{\partial v}{\partial t} + \frac{2}{vV}\frac{\partial v}{\partial t}\frac{dV}{dt} + \frac{1}{V}\frac{d^2V}{dt^2} + \frac{1}{v}\frac{\partial^2 v}{\partial t^2}\right]$$

In the case where the bag trajectory is constant velocity, we can set the velocity such that the bag will reach instability at the surface, V=V*

$$R'' = R\left[\frac{6}{z^2}V_*^2 - \frac{3}{vz}V^*\frac{\partial v}{\partial t} + \frac{1}{v}\frac{\partial^2 v}{\partial t^2}\right]$$

This expression, when properly evaluated according to other formulas given here, may predict the inflection point on which instability is predicated.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processor," "processing module", "processing circuit", and/or "processing unit" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of the various embodiments of the present invention. A module includes a processing module, a functional block, hardware, and/or software stored on memory for performing one or more functions as may be described herein. Note that, if the module is implemented via hardware, the hardware may operate independently and/or in conjunction software and/or firmware. As used herein, a module may contain one or more sub-modules, each of which may be one or more modules.

While particular combinations of various functions and features of the present invention have been expressly described herein, other combinations of these features and functions are likewise possible. The present invention is not limited by the particular examples disclosed herein and expressly incorporates these other combinations.

What is claimed is:

1. A buoyancy-based lifting system comprising:

a flexible lift bag coupled to a load being lifted;

a plurality of valves having a flow capacity, the plurality of valves including at least one inflation valve and at least one deflation valve in fluid communication with the flexible lift bag, the plurality of valves inflating or deflating the flexible lift bag by adding a compressible fluid to the flexible lift bag under control of a lift-controller;

at least one pressure sensor that obtains pressure readings during a lift, the pressure readings indicating an ambient pressure external to the flexible lift bag; and the lift-controller communicatively coupled to the plurality of valves and the at least one pressure sensor, the lift-controller including a processor that determines burst durations of the plurality of valves based on an instability ratio:

$$R_S = \frac{vV}{K_v z}$$

where $R_s$ is the instability ratio, V is a velocity of the system, $K_v$ is a valve flow rate, z is a position of the system determined based on the pressure readings, and v is an estimate of a volume of the system determined based on mass and displacement of the system and treated as a constant parameter of the system during the lift.

2. The buoyancy-based lifting system of claim 1, wherein:

the pressure readings indicating the ambient pressure external to the lift bag are the only pressure readings used in determining the instability ratio.

3. The buoyancy-based lifting system of claim 1, wherein the lift-controller comprises:

an on-board simulator that predicts a future instability ratio by performing a simulation during the lift based on the pressure readings indicating the ambient pressure external to the flexible lift bag.

4. The buoyancy-based lifting system of claim 3, wherein:

the lift-controller uses the pressure readings indicating the ambient pressure external to the flexible lift bag to estimate a current instability ratio; and the lift-controller controls the burst durations of the plurality of valves based on both the future instability ratio and the current instability ratio.

5. The buoyancy-based lifting system of claim 4, wherein:

the lift-controller activates at least one of the plurality of valves in response to the current instability ratio or the future instability ratio exceed a threshold value.

6. The buoyancy-based lifting system of claim 1, wherein:

the lift-controller estimates a state of the buoyancy-based lifting system by curve fitting the pressure readings indicating an ambient pressure external to the flexible lift bag.

7. The buoyancy-based lifting system of claim 1, wherein:

the buoyancy-based lifting system is assigned a cycle time chosen so that the buoyancy-based lifting system does not pick up so much speed during a time between valve actuations that the system exceeds an instability ratio threshold.

* * * * *